US010111005B2

(12) United States Patent
Raz et al.

(10) Patent No.: US 10,111,005 B2
(45) Date of Patent: Oct. 23, 2018

(54) METHOD AND DEVICE FOR MODIFYING AUDIO SIGNALS BASED ON HEARING CAPABILITIES OF THE LISTENER

(71) Applicant: MEQ INC., Albany, CA (US)

(72) Inventors: Ofer Raz, Albany, CA (US); Danny Aronson, Tel Aviv (IL)

(73) Assignee: EVEN INC., San Jose, CA (US)

( * ) Notice: Subject to any disclaimer, the term of this patent is extended or adjusted under 35 U.S.C. 154(b) by 0 days.

(21) Appl. No.: 15/501,255

(22) PCT Filed: Jul. 29, 2015

(86) PCT No.: PCT/IL2015/000035
§ 371 (c)(1),
(2) Date: Feb. 2, 2017

(87) PCT Pub. No.: WO2016/020908
PCT Pub. Date: Feb. 11, 2016

(65) Prior Publication Data

US 2017/0223461 A1 Aug. 3, 2017

Related U.S. Application Data

(60) Provisional application No. 62/032,572, filed on Aug. 3, 2014.

(51) Int. Cl.
*H04R 5/00* (2006.01)
*H04R 29/00* (2006.01)
(Continued)

(52) U.S. Cl.
CPC ..... *H04R 5/04* (2013.01); *H04R 5/033* (2013.01); *H04R 2430/01* (2013.01); *H04R 2430/03* (2013.01)

(58) Field of Classification Search
CPC . H04R 5/033; H04R 5/04; H04R 1/10; H04R 1/1083; H04R 1/1091;
(Continued)

(56) References Cited

U.S. PATENT DOCUMENTS 3,799,146 A 3/1974 John et al.
2002/0040254 A1 * 4/2002 Neoh ..... H04R 5/033 700/94
(Continued)

FOREIGN PATENT DOCUMENTS

WO 2006136174 A2 12/2006
WO 2014028783 A1 2/2014

*Primary Examiner* — Thang Tran
(74) *Attorney, Agent, or Firm* — Browdy and Neimark, PLLC

(57) ABSTRACT

A method and a device are provided for modifying audio signals in accordance with hearing capabilities of a specific individual who is listening to audio signals being played via a set of headphones. The method comprises the steps of: providing results of one or more hearing tests performed to the specific individual; retrieving information that relates to deviations in hearing capabilities of the individual from a pre-defined hearing pattern, based on the results obtained in the one or more hearing tests; and when the set of headphones is used by the individual while listening to input audio signals, modifying the input audio signals based on the retrieved information, thereby enabling the individual to listen to modified audio signals, being the input audio signals after their change into a form that takes into account the individual's hearing capabilities.

18 Claims, 3 Drawing Sheets

(51) Int. Cl.
*H04R 5/04* (2006.01)
*H04R 5/033* (2006.01)

(58) Field of Classification Search
CPC ..... H04R 2225/43; H04R 2225/55; H04R 25/30; H04R 25/70; H04R 29/00; H04R 2430/01; H04R 2430/03; H04S 2400/11; H04S 7/304; A61B 5/12; A61B 5/121; G10L 21/003; G06F 3/165
See application file for complete search history.

(56) References Cited

U.S. PATENT DOCUMENTS

2006/0050908 A1 3/2006 Shteyn
2007/0071263 A1 3/2007 Beck
2007/0195963 A1 8/2007 Ko et al.
2008/0269636 A1 10/2008 Burrows et al.
2009/0147962 A1 6/2009 Sieben et al.
2010/0191143 A1 7/2010 Ganter et al.
2011/0137111 A1 6/2011 Hanley et al.
2011/0200217 A1 8/2011 Gurin
2012/0014553 A1* 1/2012 Bonanno ..... H03G 3/341 381/364
2012/0130271 A1 5/2012 Margolis et al.
2012/0189130 A1 7/2012 Lee et al.
2013/0274628 A1 10/2013 Fausti et al.
2013/0314524 A1 11/2013 Lee et al.
2013/0345594 A1 12/2013 Ganter et al.
2014/0016795 A1 1/2014 Melamed
2014/0050334 A1 2/2014 Antonellis et al.
2014/0086434 A1* 3/2014 Bang ..... A61B 5/123 381/98
2014/0194775 A1 7/2014 Van Hasselt et al.
2014/0254828 A1 9/2014 Ray et al.
2014/0309549 A1 10/2014 Selig et al.
2014/0314261 A1 10/2014 Selig et al.
2015/0025413 A1 1/2015 Shennib
2016/0050507 A1 2/2016 Moore et al.

* cited by examiner

METHOD AND DEVICE FOR MODIFYING AUDIO SIGNALS BASED ON HEARING CAPABILITIES OF THE LISTENER

TECHNICAL FIELD

The present disclosure relates to the field of consumer electronics, and in particular to devices such as headphones that enable a user to listen to audio signals.

BACKGROUND

Headphones are a pair of small loudspeakers designed to be held close to the user's ears. Different types of headphones have different sound reproduction characteristics.

Headphones may be used both with fixed equipment such as CD or DVD players, home theater, personal computers and with portable devices (e.g. digital audio/player/mp3 player, mobile phone, etc.).

Headphones are available with low or high impedance (typically measured at 1 kHz). Low-impedance headphones are in the range 16 to 32 ohms whereas high-impedance headphones are about 100-600 ohms. As the impedance of a pair of headphones increases, more voltage (at a given current) is required to drive it, and the loudness of the headphones for a given voltage decreases. The impedance of headphones is of concern because of the output limitations of amplifiers. A modern pair of headphones is driven by an amplifier, with lower impedance headphones presenting a larger load. Amplifiers are not ideal; they also have some output impedance that limits the amount of power they can provide. If the amplifier's output impedance is large compared to the impedance of the headphones, a significantly higher distortion will occur. Therefore, lower impedance headphones will tend to be louder and more efficient, but will also demand a more capable amplifier. Higher impedance headphones will be more tolerant of amplifier limitations, but will produce less volume for a given output level.

Sensitivity is a measure of how effectively an earpiece converts an incoming electrical signal into an audible sound. It thus indicates how loud the headphones will be for a given electrical drive level. It can be measured in decibels of sound pressure level per milliwatt, or dB SPL/mW, which may be abbreviated to dB/mW. The sensitivity of a given pair of headphones is fixed and usually varies between about 80 and 125 dB/mW.

Everyone uses headphones the same way as the others, but since hearing capabilities change from one person to the other, the audio signals to which the users of the headphones are able to listen, change from one person to the other, depending primarily on one's hearing capabilities. The term "hearing range" usually relates to the range of frequencies that can be heard by humans, though it can also refer to the range of levels. The human range is commonly taken as 20 to 20,000 Hz, though there is considerable variations between different individuals, especially at high frequencies, and a gradual decline with age is considered to be normal. Individual hearing range varies according to the general condition of the human's ears. The range shrinks during life, usually beginning at around age of eight with the upper frequency limit being reduced. Women typically experience a lesser degree of hearing loss than men, with a later onset. Men have approximately 5 to 10 dB greater loss in the upper frequencies by the age of 40. On top of that, there may also be substantial differences between one's hearing capabilities in one ear compared to the other.

In view of the above, it is clear that the listening experience of each individual could be enhanced if the audio output to which he/she is listening, is adapted to fit that individual. Unfortunately, there are no adequate solutions to this problem yet, so that the options available for the users who wish to enhance their listening experience by having earphones that meet their needs, are for example the following:

Retrieving information form professional audio review websites that offer insight and commentary;

Retrieving information from bulletin boards and other public forums that provide comments from actual customers of the products;

Looking up for retailers who carry the items the individual is interested in, and finding out if it is possible to try them out; and Testing models owned by friends or colleagues.

Although these solutions may help an individual in assessing possible earphones that would better suit his/her needs, still they cannot be considered as solutions to the problem of tailoring the earphones to each specific individual based on his/her own hearing capabilities. No suitable solution has yet been provided to this problem, and the present invention seeks to provide such a solution.

Few solutions for personalized headphones are known in the art, among which are for example the following ones:

US 20140016795 discloses a personalized headphone comprising a first speaker and a second speaker; a cord, having a removable connector plug at a distal end adapted to maintain audio communication with the first speaker and/or the second speaker, wherein the cord comprises an audio device connector plug adapted to maintain electrical communication with a digital playback device, wherein the audio output of the speakers has a built-in preconfigured equalizer personalized to a user's age, audio file format, audio file data encoding rate and music genre.

US 20060050908 describes a system and method that determines parameters for rendering headphone audio information, based on a user's preferred acoustic rendering in a non-headphone environment. A user configures a loudspeaker-based system for a preferred ambiance. Microphones on a head-mounted device then detect the audio signals received by the user in this environment. These detected signals are compared to the audio information that is being provided by the user's audio system and the differences are used to characterize the user's particular environment. Based on this characterization, when the user uses a headphone device to listen to the audio information, a headphone driver modifies the audio information to produce audio signals at the speakers in the user's headphone to effectively reproduce the audio signals that would have been produced at the user's ears by the loudspeakers in the user's particular environment.

SUMMARY OF THE DISCLOSURE

The disclosure may be summarized by referring to the appended claims.

It is an object of the present disclosure to provide a new method for modifying audio signals in accordance with hearing capabilities of an individual who is listening to the modified audio signals.

It is another object of the present disclosure to provide a new set of headphones, capable of modifying audio signals in accordance with hearing capabilities of an individual who is listening to the audio signals.

It is still another object of the present disclosure to provide a device capable of modifying audio signals in accordance with hearing capabilities of an individual who is listening to the audio signals via any set of headphones.

Other objects of the present invention will become apparent from the following description.

According to a first embodiment of the present disclosure, there is provided a method for modifying audio signals in accordance with hearing capabilities of a specific individual who is listening to audio signals being played via a set of headphones. The method provided, comprises the steps of:

providing results of one or more hearing tests performed to the specific individual. The results provided may be results of tests conducted for that individual in a testing facility (e.g. a medical facility) or results of self-tests carried out by the individual;

retrieving information that relates to deviations in hearing capabilities of the individual from a pre-defined hearing pattern, based on the results obtained in the one or more hearing tests; and when the set of headphones is used by the individual while listening to input audio signals, modifying the input audio signals based on the retrieved information, thereby enabling the individual to listen to modified audio signals, being the input audio signals after their change into a form that takes into account the individual's hearing capabilities.

The term "set of headphones" as used herein throughout the specification and claims is used to denote typically a pair of small loudspeakers designed to be held in place close to an individual's ears. They are also known as earspeakers, earphones, etc. Typically, there are three types of headphones—in-ear, on the ear and covering the entire ear. The alternate in-ear versions are also known as earbuds or earphones. Headphones either have wires for connection to a signal source such as an audio amplifier, radio, CD player, portable media player, mobile phone, electronic musical instrument, or have a wireless device, which is used to pick up signal without using a cable. Also, although this term typically relates to a pair of earphones it should be understood to encompass different cases, e.g. a single earphone.

The term "hearing test" as used herein throughout the specification and claims is used to denote a test carried out to determine hearing capabilities of one or both ears of an individual. The hearing test may be conducted as two separate tests, each for a different ear of the individual, or as one test for determining the combined individual's hearing capabilities when both ears are being subjected simultaneously to the hearing test.

The term "hearing capabilities" as used herein throughout the specification and claims is used preferably but not exclusively to denote gaps that exist between tones as they may be heard by an individual who listens to audio tones, and the same audio tones as they should have been heard by the individual, had he/she had a perfect hearing ability. For the same individual, the gap may be different at different frequencies (or at different ranges of frequencies) and may vary from one of the individual's ears to the other. These gaps, provide a characterization of the hearing capabilities of the individual, may be taken into account when establishing how should the audio tones be modified, when they will be played eventually to that individual When reference is made throughout the specification and claims to information that relates to the hearing capabilities of an individual, it should be understood to encompass each of the following options or any combination thereof: the results of one or more hearing tests which that individual has undergone, and/or any data that was derived from the results of one or more hearing tests, e.g. data to enable taking into account that individual hearing capabilities when determining how to modify the audio signals (such as compensation related data).

According to another embodiment of the present disclosure, the one or more hearing tests are performed while the individual is using the set of headphones.

By yet another embodiment, the method provided further comprises a step of storing the retrieved information in a memory (e.g. memory that is included within the set of headphones, or at a remote location). Also, it should be understood that cases in which the stored information comprises data that has been derived based on the retrieved information, are also included within the scope of the present disclosure and hence are encompassed by the present invention.

In accordance with another embodiment, the step of performing the one or more hearing tests comprises performing at least two separate hearing tests to determine deviations from a respective pre-defined hearing pattern, in each the individual's ears' hearing capabilities.

In accordance with yet another embodiment, the method further comprises a step of determining for at least one of the individual's ears, at least one frequency at which the input audio signal will be modified and how should this modification be carried out (e.g. change of amplitude, change of intensity of the compensated signal, etc.) to a portion of the audio signal associated with that at least one frequency.

By still another embodiment, the one or more hearing tests comprises testing the individual's hearing capabilities at frequencies which are above 3000 Hz (e.g. up to about 14 KHz).

According to yet another embodiment, the step of retrieving information that relates to deviations of the individual's hearing capabilities from a pre-defined hearing pattern further comprises retrieving information that would allow determining a comfortable volume baseline for that individual.

In accordance with another embodiment, the method further comprises a step of determining, for at least one of the individual's ears, at least one range of frequencies at which the input audio signal will be modified, and how should the modification of the input audio signal be carried out for that range of frequencies.

By still another embodiment, the method further comprises a step of processing the retrieved information that relates to deviations in hearing capabilities of the individual, establishing the individual's hearing capabilities at one or more frequencies, and determining at least one frequency at which the input audio signal will be modified which is different from the one or more frequencies at which it has been established that there is a deterioration in the individual's hearing capabilities.

According to another aspect of the present disclosure there is provided a configurable set of headphones comprising an audio signal ingress that enables connecting the set of headphones to a device configured to play audio signals, and at least one processor comprised within that set of headphones and adapted to:

receive results of one or more hearing tests performed to a specific individual;

retrieve information that relates to deviations in hearing capabilities of the individual from a pre-defined hearing pattern, based on the results obtained in the one or more hearing tests; and modify input audio signals received via the audio signal ingress based on the retrieved information, thereby enabling the individual to listen to modified audio signals being the input audio signals after their modification into a form that takes into account the individual's hearing capabilities.

According to another embodiment of this aspect of by yet another embodiment, the configurable set of headphones further comprises a memory configured to store information associated with deviations in the individual's hearing capabilities from a respective pre-defined hearing pattern, derived from the one or more hearing tests which the individual has undergone By yet another embodiment, the processor is configured to initiate the one or more hearing tests (e.g. two separated tests, each for one of the individual's ears) and to determine from the tests' results, deviations from a respective pre-defined hearing pattern in the individual's hearing capabilities. According to this embodiment, the configurable set of headphones is associated with a user input interface (e.g. a button) to enable the individual to indicate which tones are heard by him/her.

In accordance with another embodiment, the processor is further operative to determine for at least one of the individual's ears, at least one frequency at which the input audio signal will be modified and the modification (e.g. change of amplitude, change of level of the modified (compensated) signal, change of frequency etc.) that will be carried out to the portion of the audio signal associated with that at least one frequency.

By yet another embodiment, based on test results obtained for determining the individual's hearing capabilities at one or more frequencies, the modification of the input audio signals is carried out at at least one frequency that is different from the one or more frequencies for which the test results were obtained.

By yet another embodiment of this aspect of the disclosure, the one or more hearing tests comprises testing the individual's hearing capabilities at frequencies of above 3000 e.g. up to about 14 KHz.

According to still another embodiment, the processor is further operative to retrieve information to enable determining a comfortable volume baseline for the user, which will be applied when the input audio signals will be modified by that processor.

In accordance with another embodiment, the processor is further operative to determine for at least one of the individual's ears, at least one range of frequencies at which the input audio signals will be modified, and how should the modification(s) be carried out at that range of frequencies.

By still another embodiment, the processor is further operative to process the retrieved information that relates to deviations in hearing capabilities of the individual, to establish the hearing capabilities at one or more frequencies, and to determine at least one frequency at which the input audio signal will be modified which is different from the one or more frequencies at which the individual's hearing capabilities have been established.

By yet another embodiment there is provided a computer program product encoding a computer program stored on a non-transitory computer-readable medium for executing a set of instructions by one or more computer processors for establishing a process for carrying out the method of the present disclosure.

In accordance with still another aspect there is provided a device configured to modify audio signals in accordance with hearing capabilities of a specific user while that user is listening to audio signals being played via a set of headphones. The device comprises an audio signal ingress that enables connecting the set of headphones to a device configured to play audio signals, and at least one processor, configured to: receive information that relates to deviations in hearing capabilities of a specific individual from a pre-defined hearing pattern derived from results of one or more hearing tests performed to a specific individual; and modify input audio signals received via the audio signal ingress based on the information retrieved and/or processed, thereby enabling the specific individual to listen to modified audio signals, being the input audio signals after their modification into a form that takes into account the individual's hearing capabilities.

BRIEF DESCRIPTION OF THE DRAWINGS

For a more complete understanding of the present invention, reference is now made to the following detailed description taken in conjunction with the accompanying drawings wherein.

DETAILED DESCRIPTION

In this disclosure, the term "comprising" is intended to have an open-ended meaning so that when a first element is stated as comprising a second element, the first element may also include one or more other elements that are not necessarily identified or described herein, or recited in the claims.

In the following description, for the purposes of explanation, numerous specific details are set forth in order to provide a better understanding of the present invention by way of examples. It should be apparent, however, that the present invention may be practiced without these specific details.

Figure 1:
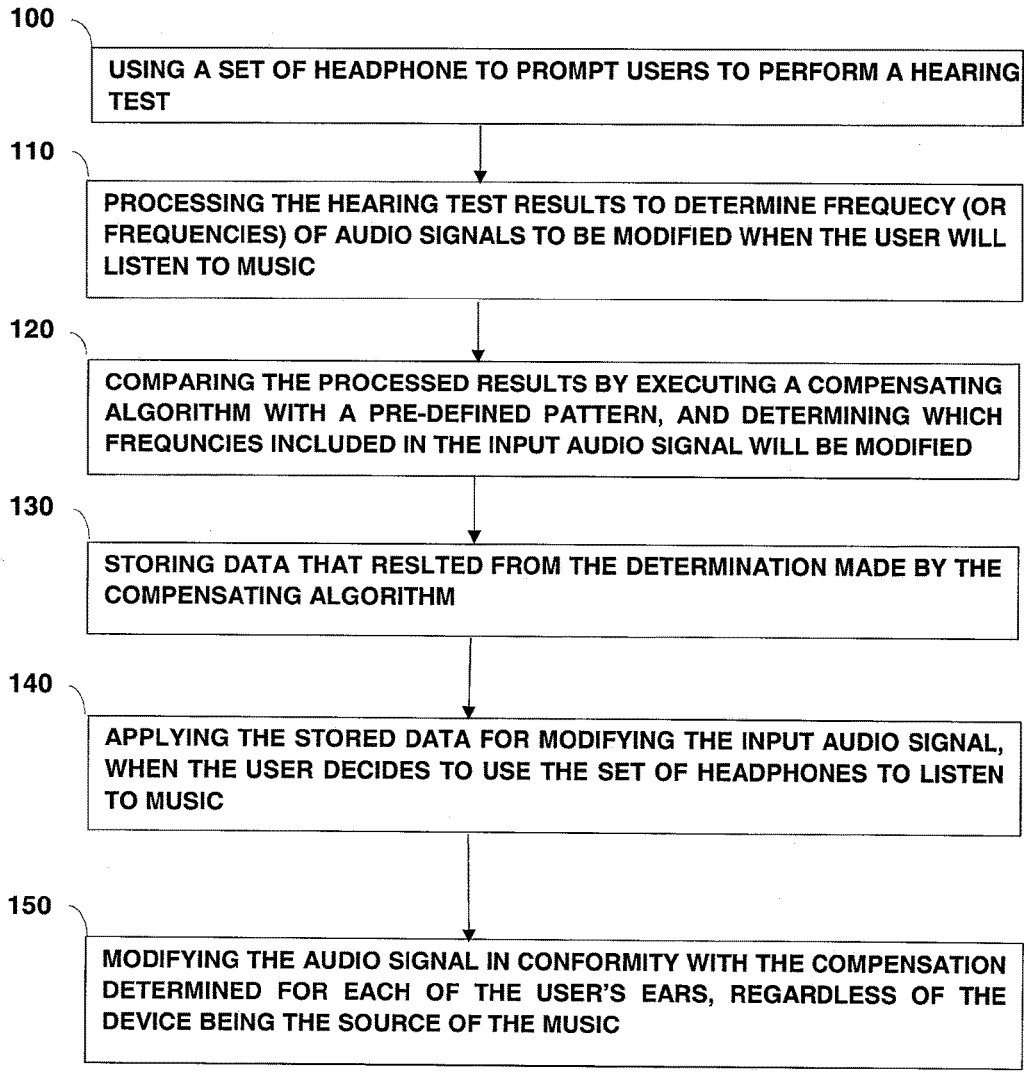
FIG. 1—is a flow diagram exemplifying a method carried out in accordance with an embodiment of the present invention.
Figure 3:
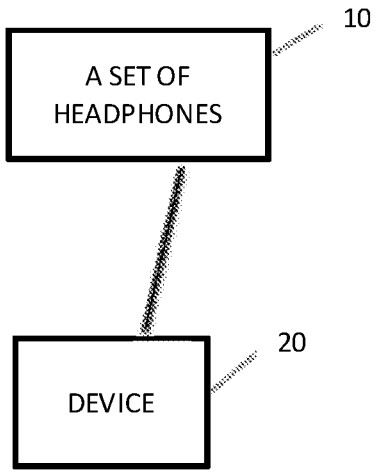
FIG. 3—is a system to carry the method in FIG. 1.

FIG. 1 is a flow diagram illustrating a non-limiting example of a method carried out in accordance with an embodiment of the present invention, and FIG. 3 is a system comprising a set of headphones 10 connected to a device 20 to carry out the method in FIG. 1 by using at least one processor provided in the headphones 10 or the device 20.

In step 100 a set of headphones 10, comprising a DSP component, and an Android/iPhone/iPad/laptop software application was used to prompt three different individuals to go through a comprehensive, custom-made hearing test. This test differs from standard hearing tests as it was designed to test primarily frequencies that pertain to the comprehension and enjoyment of music, and are thus different from conventional tests that focus solely on frequencies that make speech more comprehensible for those experiencing hearing loss.

The hearing tests were performed for each ear of each of the individuals, generating two distinct audiograms for each individual, one for the individual's left ear and one of the individual's right ear.

The term "audiogram" as used herein is used to denote a graph that shows the audible threshold for frequencies as measured by an audiometer. The Y axis represents intensity measured in decibels while the X axis represents frequency measured in Hertz. The threshold of hearing is plotted relative to a standardized curve that represents normal hearing, in dB.

For humans, normal hearing is between −10 dB and 15 dB, although 0 dB from 250 Hz to 8 kHz is deemed to be 'average' normal hearing. Typically, hearing thresholds of humans are found by using hearing tests that involve different tones being presented at a specific frequency (pitch) and intensity (loudness). When the person hears the sound they press a button so that the testing means recognizes that they have heard it. The lowest intensity sound they can hear is recorded.

Figure 2:
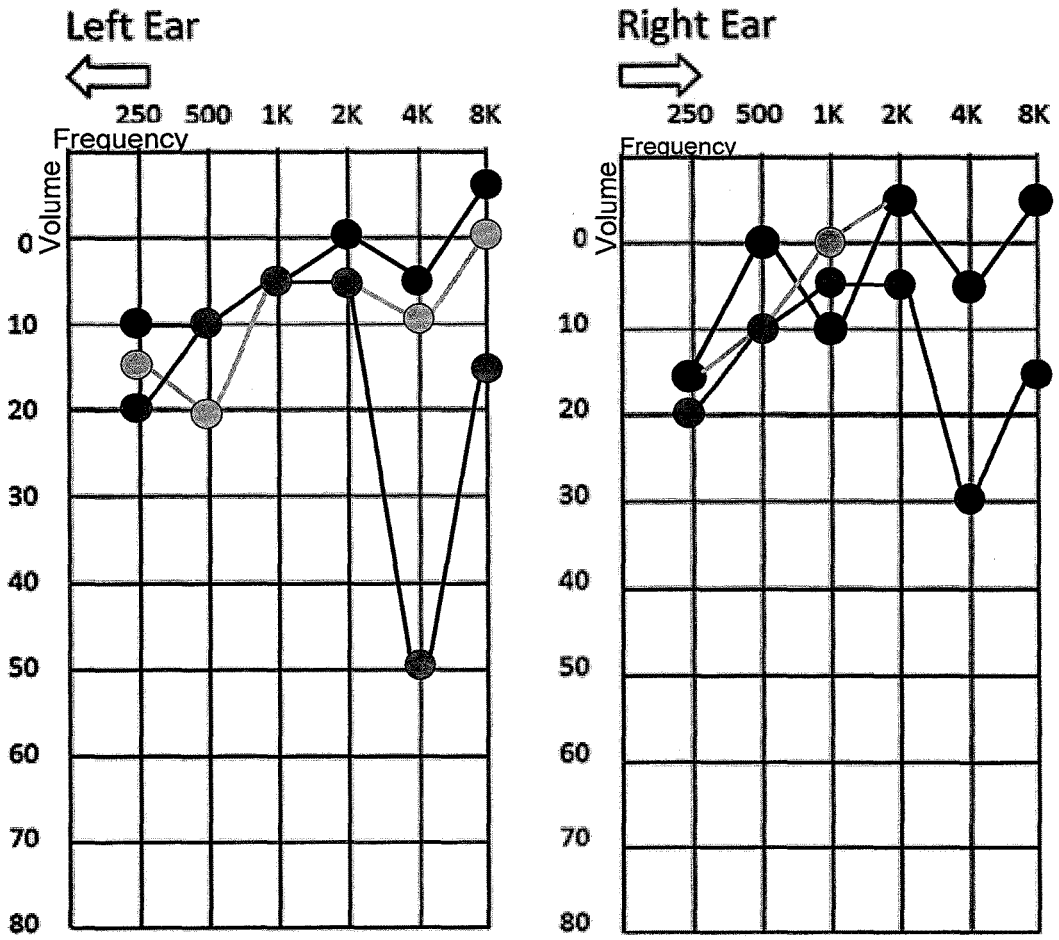
FIG. 2—is an example of the results of hearing tests performed on three different individuals.

The actual audiograms that resulted from the hearing tests performed to each of these three individuals' left ears and right ears, are presented in FIG. 2. As may be seen in this Fig., there are substantial differences, for example between the hearing capabilities in both ears of individual No. 3 as compared with the hearing capabilities of individuals 1 and 2, and particularly in the range of 2000 to 8000 Hz.

The results obtained in these tests were analyzed (step 110) in order to determine for each individual which ranges of frequencies of the audio signals will be modified when that respective individual will listen to music, and what will be the level of compensation (e.g. at how many frequencies (or frequency bands) will the modification be made, the intensity of the modified signal, etc.) at each of these ranges.

At first, the analysis results were compared (step 120) by executing a compensation algorithm with a pre-defined pattern (e.g. a straight line having a volume equal to zero throughout the whole frequency spectrum that was checked in the test), and then the compensating algorithm, which may include equalization process, determines the frequency ranges at which the audio signals will be modified by applying the appropriate compensation for the respective individual. In other words, the compensating algorithm uses predetermined equalizing (EQ) bands and curves to determine the compensation that will be provided to each of the individual's ears. Typically, the compensation (e.g. the frequency ranges in which the modification will be carried out and/or the intensity of compensation) that will be provided to the audio signals reaching the individual's left ear will be different from the compensation that will be provided to the audio signals reaching the individual's right ear, based on the resulting audiograms.

It should be noted that determining the required compensation is a complex process, one which takes into account different frequencies and bands (in terms of the range of frequencies affected) and does not create a simple "mirror" image of the users' audiogram. Instead, it is preferably used to generate a smooth and enjoyable equalized curve for each ear. For example, if an individual has a 3 db drop at around 500 Hz, it might be more musically pleasing to increase the intensity of signals of frequencies around 500 Hz by 2.5 db through a broadband curve extending from say 450 Hz to 570 Hz, rather than just increasing the 500 Hz signals by 3 db. Another example could be to reduce the level of few frequencies around the 500 Hz frequency instead of increasing the intensity of the signal at the 500 Hz frequency.

Next, in step 130, data resulting from the determination made by the compensation algorithm, are stored (e.g. as a firmware at the DSP comprised within the headphones), and when the individual decides to use the headphones to listen to music, the data resulting from the compensation algorithm that has been stored, is provided to two customized equalizers (step 140) (for the L/R ears) in such a way that the audio signals may be modified in each of the two channels, accordingly.

Optionally, but not necessarily, after completing the compensation process described above for both ears of the individual, the individual is able to carry out a test where he/she listens to a musical creation with and without applying the modification, and then to indicate whether a different compensation should be applied. After the individual has indicated that the compensation results are satisfactory, the equalization data (i.e. frequency, volume and "Q" value are forwarded to the DSP comprised within the headphones themselves, with or without changing the firmware embedded at the DSP, for storing the customized equalization data in the headphones.

The value of parameter "Q" referred to above, relates to the angle and scope of the gain given for each frequency band. It may be very sharp and bell shaped, thus affecting only a rather narrow range of frequencies, or on the other hand it may be quite flat and large, thus affecting a larger range of frequencies.

Forwarding the data to the DSP may be done by using a USB, wireless communication (e.g. WiFi, Bluetooth etc.), audio input encoded as audio signal or any other applicable technology, or any combination thereof.

When the individual decides to listen to music (step 150) through his/here own headphones, the audio signals are modified in conformity with the compensation determined for each of the individual's ears, regardless of the device being used as the source of the music.

Although the compensation process described in this example relates to compensating each ear separately, it should be clear that the present invention also encompasses cases where the compensation is made for one ear only, or where there is essentially the same compensation for both ears of the individual. At the latter case, the hearing test may be one test where both ears are tested simultaneously to receive a combined result, or that the ears are tested separately and the results obtained for each of the two ears are combined while determining the compensation that will be applied while modifying the audio signals.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention in any way. The described embodiments comprise different features, not all of which are required in all embodiments of the invention. Some embodiments of the present invention utilize only some of the features or possible combinations of the features. For example, although the description above relates to carrying out the method provided by components comprised within the set of headphones, still, it should be appreciated that the method may be exercised by having an intermediate device comprising the DSP described above which will be fitted between any headphone jack and the headphones themselves (any set of headphones). This will allow users to improve their sound listening experience by implementing the method described herein, without having to change their set of headphones, or without having to buy any particular set of headphones.

Variations of embodiments of the present invention that are described and embodiments of the present invention comprising different combinations of features noted in the described embodiments will occur to persons of the art. The scope of the invention is limited only by the following claims.

The invention claimed is:

1. A method for modifying audio signals in accordance with hearing capabilities of a specific individual who is listening to audio signals being played via a set of headphones, said method comprises the steps of:

obtaining results of one or more hearing tests performed to the specific individual and associated with tones that the specific individual had indicated, by using a user interface, that he/she can hear, wherein the results include two distinct audiograms, one for each of the individual's ears;

determining deviations in hearing capabilities of the individual from a pre-defined hearing pattern, based on the results obtained in the one or more hearing tests; and modifying audio signals based on the determined deviations in the hearing capabilities of the specific individual, wherein modifying the audio signals includes applying a different compensation for each of the individual's ears, thereby enabling the individual to listen to modified audio signals that takes into account the individual's hearing capabilities.

2. The method of claim 1, wherein the one or more hearing tests are performed while the individual is using the set of headphones, and said method further comprises a step of storing information associated with the results obtained in the one or more hearing tests, in a memory included within the set of headphones.

3. The method of claim 1, further comprising performing at least two separate hearing tests to determine deviations in the hearing capabilities in each of the individual's ears, from a pre-defined hearing pattern.

4. The method of claim 1, further comprising a step of determining for at least one of the individual's ears, at least one frequency at which the audio signals will be modified and the modification that will be carried out to a portion of the audio signals associated with that at least one frequency.

5. The method of claim 1, further comprising testing the individual's hearing capabilities at frequencies which are above 3000 Hz.

6. The method of claim 1, further comprising retrieving information that would allow determining a comfortable volume baseline for said individual.

7. The method of claim 1, further comprising a step of determining for each of the user's ears, at least one range of frequencies at which the audio signal will be modified, and one or more modifications of the audio signals that will be carried out for that range of frequencies.

8. The method of claim 1, further comprising a step of processing the results of one or more hearing tests, establishing said hearing capabilities at one or more frequencies, and determining at least one frequency at which the audio signals will be modified, which is different from the one or more frequencies at which the individual's hearing capabilities have been established.

9. A configurable set of headphones comprising an audio signal ingress that enables connecting the set of headphones to a device configured to play audio signals, and at least one processor comprised within that set of headphones and configured to:

obtain results of one or more hearing tests performed to a specific individual and associated with tones that the specific individual had indicated that he/she can hear, wherein the results includes two distinct audiograms, one for each of the individual's ears;

determine deviations in hearing capabilities of the individual from a pre-defined hearing pattern, based on the results obtained in the one or more hearing tests; and modify audio signals received via the audio signal ingress based on the determined deviations in the hearing capabilities of the specific individual, wherein modifying the audio signals includes applying a differing compensation for each of the individual's ears, thereby enabling the individual to listen to modified audio signals that takes into account the individual's hearing capabilities.

10. The configurable set of headphones of claim 9, wherein said at least one processor is configured to initiate the one or more hearing tests and to determine from indications received from the individual, the deviations in the individual's hearing capabilities from a respective pre-defined hearing pattern.

11. The configurable set of headphones of claim 9, further comprising a memory configured to store information associated with the determined deviations in the individual's hearing capabilities from a respective pre-defined hearing pattern.

12. The configurable set of headphones of claim 9, wherein said at least one processor is further operative to determine at least one frequency at which the audio signals will be modified and the modification that will be carried out to a portion of the audio signals associated with said at least one frequency.

13. The configurable set of headphones of claim 9, wherein said at least one processor is further operative to retrieve information to enable determining a comfortable volume baseline for the individual.

14. The configurable set of headphones of claim 9, wherein said at least one processor is further operative to determine for each of the individual's ears, at least one range of frequencies wherein audio signals will be modified, and one or more modifications that will be carried out at that range of frequencies.

15. The configurable set of headphones claim 9, wherein said at least one processor is further operative to process the results of one or more hearing tests, to establish said hearing capabilities at one or more frequencies, and to determine at least one frequency at which the audio signals will be modified, which is different from the one or more frequencies at which the individual's hearing capabilities have been established.

16. A device configured to modify audio signals in accordance with hearing capabilities of a specific individual when said specific individual is listening to audio signals being played via a set of headphones, said device comprising at least one processor which is configured to:

perform one or more hearing tests to the specific individual;

receive information that relates to deviations in hearing capabilities of the specific individual from a pre-defined hearing pattern derived from results of the one or more hearing tests, wherein the results associated with tones that the specific individual had indicated that he/she can hear, and includes two distinct audiograms, one for each of the individual's ears; and modify audio signals received based on the received information, wherein modifying the audio signals includes applying a different compensation for each of the individual's ears, thereby enabling the individual to listen to modified audio signals that takes into account the individual's hearing capabilities.

17. A computer program product encoding a computer program stored on a non-transitory computer-readable medium for executing a set of instructions by one or more computer processors for establishing a process for carrying out the method of claim 1.

18. The method of claim 1, wherein modifying the audio signals includes applying a first compensation to the audio signals reaching the individual's left ear and a second compensation to the audio signals reaching the individual's right ear, and wherein the second compensation differs from the first compensation.

* * * * *